United States Patent [19]

Jozat et al.

[11] Patent Number: 5,052,841

[45] Date of Patent: Oct. 1, 1991

[54] STYLO PEN TIP

[75] Inventors: Walter Jozat, Bad Bramstedt; Steffen Wünsche, Hamburg, both of Fed. Rep. of Germany

[73] Assignee: Koh-I-Noor Inc., Hamburg, Fed. Rep. of Germany

[21] Appl. No.: 524,968

[22] Filed: May 18, 1990

[30] Foreign Application Priority Data

Jun. 27, 1989 [DE] Fed. Rep. of Germany ..... 3921005

[51] Int. Cl.[5] ..... B43K 8/16

[52] U.S. Cl. ..... 401/258; 401/259

[58] Field of Search ..... 401/258, 259, 260

[56] References Cited

U.S. PATENT DOCUMENTS

| | | | |
|---|---|---|---|
| 507,348 | 10/1893 | Beaumel | 401/258 |
| 2,217,502 | 10/1940 | Wallace . | |
| 3,561,881 | 2/1971 | Bok | 401/258 |
| 3,905,709 | 9/1975 | Bok | 401/258 |
| 4,408,921 | 10/1983 | Nagai | 401/89 |
| 4,522,525 | 6/1985 | Saito et al. | 401/259 X |
| 4,728,214 | 3/1988 | Mutschler | 401/258 |
| 4,753,546 | 6/1988 | Witz et al. . | |
| 4,938,620 | 7/1990 | Weiss et al. . | |

FOREIGN PATENT DOCUMENTS

| | | | |
|---|---|---|---|
| 0341484 | 11/1989 | European Pat. Off. . | |
| 744671 | 1/1944 | Fed. Rep. of Germany . | |
| 1984015 | 8/1964 | Fed. Rep. of Germany . | |
| 1611802 | 3/1970 | Fed. Rep. of Germany . | |
| 1903496 | 8/1970 | Fed. Rep. of Germany | 401/260 |
| 2001553 | 5/1971 | Fed. Rep. of Germany . | |
| 3400522 | 7/1985 | Fed. Rep. of Germany . | |
| 3434188 | 3/1986 | Fed. Rep. of Germany . | |
| 3538285 | 7/1986 | Fed. Rep. of Germany | 401/199 |
| 3538286 | 7/1986 | Fed. Rep. of Germany | 401/199 |
| 3815712 | 11/1989 | Fed. Rep. of Germany . | |
| 3835146 | 11/1989 | Fed. Rep. of Germany . | |
| 986766 | 8/1951 | France . | |
| 149734 | 9/1931 | Switzerland | 401/260 |
| 1231988 | 5/1971 | United Kingdom . | |

*Primary Examiner*—Steven A. Bratlie

*Attorney, Agent, or Firm*—Fitzpatrick, Cella, Harper & Scinto

[57] ABSTRACT

A stylo pen tip with a drop weight body (7) which is located inside an inner bore (6) of a housing (1,1') connected with the writing fliud reservoir (16) and which has a cleaning wire (8) at its front end extending into the writing tube (2) supported on the front end of the housing (1, 1') has a drop weight safety (13) supported therein which is pivotable around the longitudinal axis of the housing (1,1') and which is in interlocking contact with the drop weight body (7), which can be moved back and forth axially in a limited way in relation to it. In its forward position the drop weight body (7) adjoins with its front end (10) a stop face (9) formed in the inner bore (6). The plane of the front end (10) of the drop weight body (7) and the plane of the stop face (9) are inclined towards each other. By turning of the drop weight body (7) the extension of the cleaning wire (8) beyond the front end of the writing tube (2) can be adjusted.

10 Claims, 2 Drawing Sheets

STYLO PEN TIP

BACKGROUND OF THE INVENTION

1. Field of the Invention

The invention relates to a tip of a stylo pen with a drop weight body, located inside an inner bore of a housing connected with the writing fluid reservoir. The pen has a cleaning wire at its front end extending into the writing tube supported on the front end of the housing, and a drop weight safety supported therein. The drop weight safety is pivotable around the longitudinal axis of the housing and is in interlocking contact with the drop weight body, which can be moved back and forth axially in a limited way in relation to the safety.

2. Background of the Invention

A known stylo pen tip of this type (German Patent 34 34 188) is designed in such a way that an extension of the cleaning wire beyond the front end of the writing tube can be adjusted by means of a change in the position of the drop weight safety. The drop weight body is suspended in the sidewall areas of a drop weight safety that extends into the inner bore. Axial back and forth movement is made possible by interaction of the drop weight safety and the drop weight body. The forward position of the drop weight body in particular, and thus also the extension of the cleaning wire beyond the front end of the writing tube thereby can be fixed. Such a known stylo pen tip, therefore, permits setting of the extension of the cleaning wire beyond the front end of the writing tube. Furthermore, in disassembly and renewed assembly of the drop weight body there is no need to reset this extension. However, this known design has a comparatively complicated structure and, in particular, requires a drop weight safety composed of several parts, one part of which being fixedly connected with the housing after the extension has been set, for the first time.

In the published German Patent Application P 38 35 146.3, which corresponds to pending U.S. Ser. No. 07/347,215 now U.S. Pat. No. 5,000,606 it was proposed to clampingly support an axially displaceable bush element on the drop weight body, which has a rear annular shoulder area supported in the forward position of the drop weight body at an annular shoulder in the rear section of the inner bore. The extension of the cleaning wire beyond the front end of the stylo pen can be set by a change in the position of the bush element on the drop weight body. For this purpose the drop weight body must be removed out of its forward position, the bush element must be displaced and then, in the forward position of the drop weight body, the extension of the cleaning wire beyond the front end of the stylo pen again must be checked.

OBJECT AND SUMMARY OF THE INVENTION

It is an object of the invention to provide a stylo pen tip which permits an adjustment to the extension of the cleaning wire beyond the front end of the writing tube without special efforts, and in such a way that the drop weight body remains in its forward position during the entire adjustment process.

To attain this object, a stylo pen tip according to the invention is designed so that in a forward position the drop weight body rests with a front surface against a stop face provided in the inner bore. Further, the plane of the front surface of the drop weight body and the plane of the stop face are inclined towards each other.

Thus, in a stylo pen tip in accordance with the invention there is, in contrast to customary stylo pen tips, an inclination between those surfaces determining the forward position of the drop weight body inside the inner bore. Hence, the axial position of the drop weight body, and thus also the axial position of the cleaning wire in respect to the writing tube, can be altered with the drop weight body in the forward position. Alternating can be by a turning with respect to the housing, i.e. by a corresponding turning of the drop weight safety. During assembly of the stylo pen tip, the cleaning wire can be maintained in such a way that the drop weight body is in its forward position. Therefore, the extension of the cleaning wire beyond the front end of the writing tube can be observed as the drop weight safety is being turned until a desired extension is achieved. Afterwards, it is possible to fix the drop weight safety in the housing, if by gluing, ultra-sound welding, or the like.

In a preferred embodiment of the invention, the plane of the front surface of the drop weight body extends vertically to the longitudinal axis of the drop weight body. In this manner the stop face surface which is inclined in respect to the drop weight is in the inner bore. During the manufacture of the housing, as by the injection molding process, this stop face easily can be made in a desired shape.

Customarily, the front surface of the drop weight body designed to contact with the stop face will be the surface located at the front end of the drop weight body and into which the cleaning wire has been inserted. In this case, the front surface of the drop weight body may have a length which in general, is equal to the diameter of the drop weight body. In contrast thereto, the drop weight body has a width decreasing in a forward direction by a tapering of the drop weight body. Hence, in any possible pivoted position of the drop weight body, an arrangement results where the front surface does not hinder a supply of writing ink from the inner bore, into the writing tube.

An indentation also may be provided in the rear surface of the drop weight body. The drop weight safety also may have a protrusion which is slightly less in thickness than the inner diameter of the indentation, and a greater width than that of the inner diameter of the indentation. For positive engagement with the drop weight body, this protrusion may extend into the indentation so that its front end remains at a distance from the bottom of the indentation, when the drop weight body is in its forward position.

The invention will be described in more detail below by means of drawings, showing an exemplary embodiment.

DETAILED DESCRIPTION OF THE PREFERRED EMBODIMENT

Figure 1:
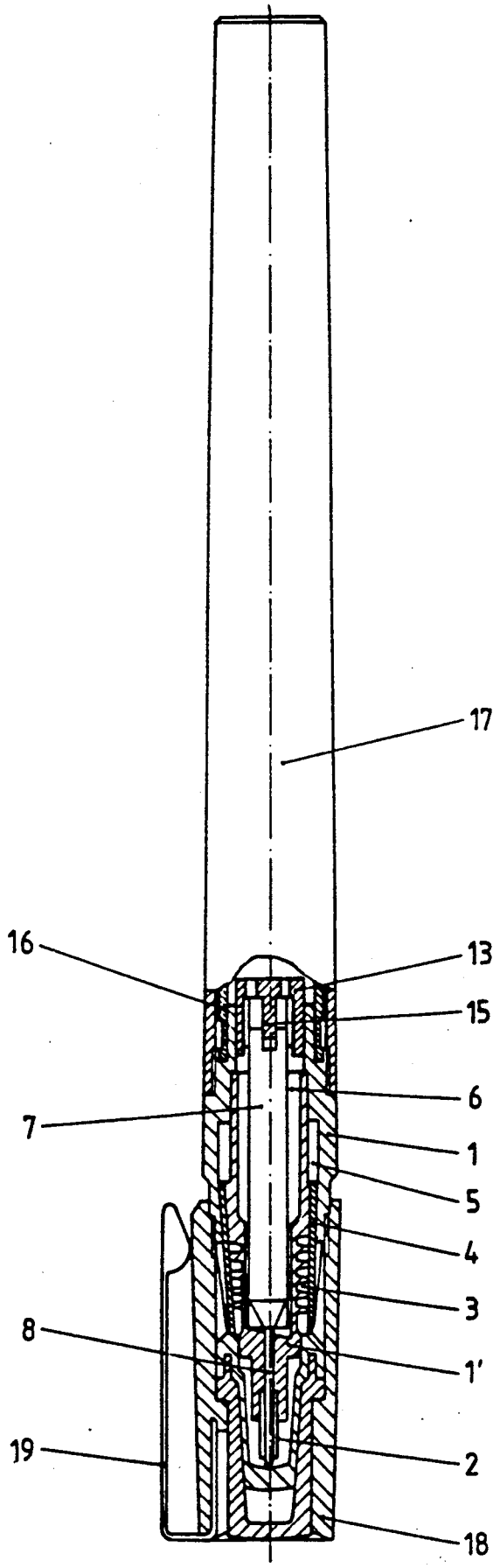
FIG. 1 is a partial section and partial plan view of a stylo pen comprising a stylo pen tip, writing fluid cartridge, holder and protective cap.
Figure 3:
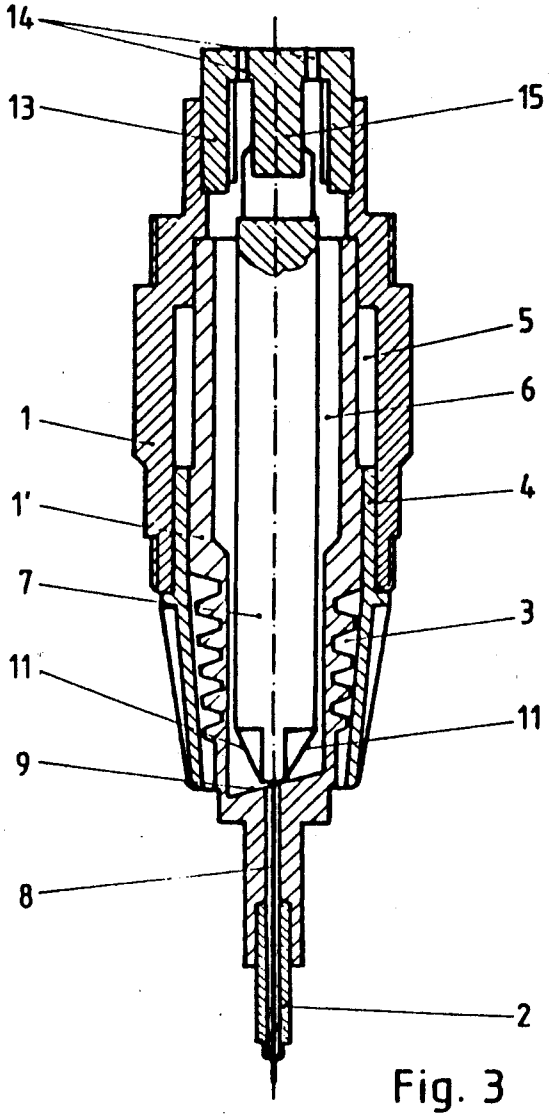
FIG. 3 is a section corresponding to FIG. 2, but with the drop weight safety turned by 90 degrees and the drop weight body turned a corresponding amount.

The stylo pen shown in FIG. 1 has a stylo pen tip which can best be described by reference to FIGS. 2 and 3. A customary writing fluid cartridge 16, partially shown, is attached to the pen rear end and a holder 17 is screwed on it from the rear, also in the customary manner. A protective cap 18 of customary design is screwed on the stylo pen tip from the front, and the cap has a customary clip 19.

The stylo pen tip has a housing formed of two parts 1,1'. An annular space 3,5, open towards the front, is located between those parts, into which a cover sleeve 4 clampingly has been inserted. The sleeve covers a spiral-like annular groove formed on the outer surface of the part 1' of the housing, to define a pressure equalization chamber, which connects the inner bore 6 of the housing 1,1' with the ambient air in a customary way. A writing tube 2 of customary construction is fixed into the front end of the part 1' of the housing. The writing tube is connected via a connecting bore, not shown, with the front end of the inner bore 6.

A cleaning wire 8 extends into the connecting bore and into the writing tube 2. The wire is fastened at the front end of a drop weight body 7 that is supported in the inner bore 6 so that it can move back and forth in an axially limited manner. The drop weight is in its forward position, in the drawings. The back end of the inner bore 6 is closed by a cup-shaped drop weight safety 13, clampingly inserted into the part 1 of the housing. The bottom of the safety has openings 14 to connect the inner bore 6 with a writing fluid reservoir which, according to FIG. 1, is a writing fluid cartridge 16.

As shown, a lateral indentation 12, open toward the back, is located within the back end of the drop weight body 7. A lateral protrusion 15 starts from the bottom of the drop weight safety 13, and has a thickness slightly less than the width of the lateral indentation 12. Hence, drop weight body 7 can be moved back and forth in relation to the protrusion 15 in an axial direction. The length of the lateral protrusion 15 is greater than the width of the lateral indentation 12, so that the protrusion 15 is not freely pivotable within the indentation 12. Hence, if the drop weight safety 13 is turned around its longitudinal axis (which also is the longitudinal axis of the housing 1,1') the longitudinal axis of the drop weight body 7 and the longitudinal axis of the writing tube 2 will turn. For example by turning the safety 90 degrees from the position of FIG. 2 into the position of FIG. 3, the protrusion 15, because of its interaction with indentation 12, will move the drop weight body 7 along during such a turning. The protrusion 15 is in positive connection with the indentation 12 in any position of the drop weight body 7, so that in the forward position of the drop weight body 7, as illustrated, the protrusion is located with its front end inside the indentation 12, but above its bottom, thereby allowing an axial back and forth movement of the drop weight 7.

The drop weight, has on its front end, a forwardly oriented inclination 11, so that a generally rectangular front end 10 results, with a length that corresponds to the diameter of the drop weight body 7 and a width determined by the inclination 11. From this front end protrudes the cleaning wire 8. A stop face 9, formed on the front end of the inner bore 6, is located adjacent to the front end 10 of the drop weight body 7. A connecting bore from the inner bore 6 to the writing tube 2 extends through the stop face. While the front end 10 of the drop weight body 7 extends perpendicular to its longitudinal axis, the stop face 9 of the inner bore is inclined to that longitudinal axis, for example, by an angle of between approximately 10 and 30 degrees.

Figure 2:
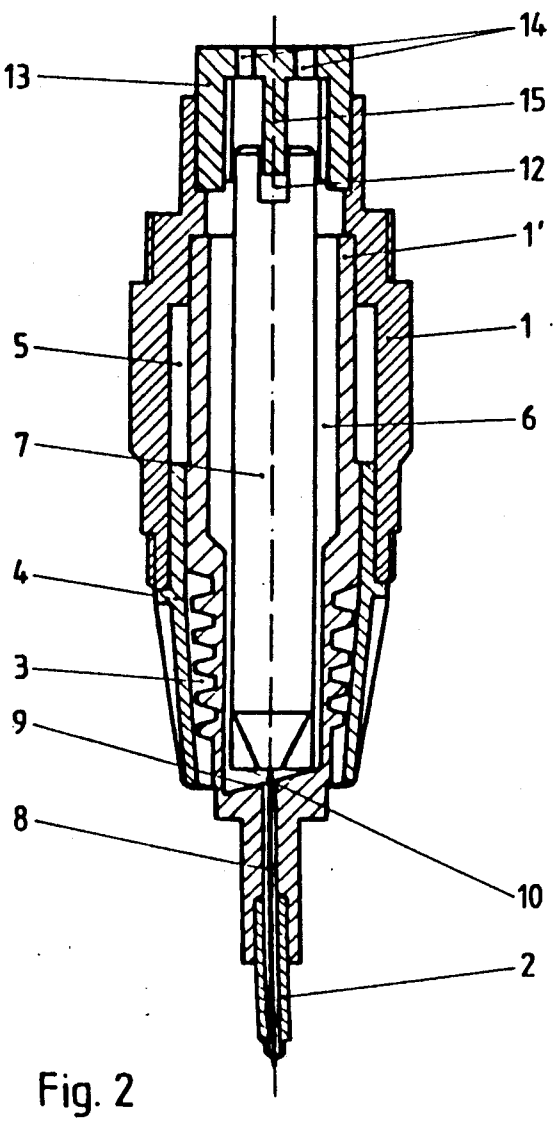
FIG. 2 is a section through the stylo pen tip of FIG. 1.

If the drop weight body 7 is turned by 90 degrees out of the position shown in FIG. 2, where its front end 10 is supported on the part of the stop face 9 located further back in relation to the position of the writing tube 2, the front end of the drop weight body 7 is supported on an area of the stop face 9 which is located further towards the front. This can be seen in FIG. 3. Hence, as also indicated in FIG. 3, the drop weight body 7 then is located in forward position that is further towards the front than in the position shown in FIG. 2. This results, also as indicated in FIG. 3, in a greater extension of the cleaning wire 8 beyond the front end of the writing tube 2.

While an exemplary embodiment of the invention has been shown and described, it is to be understood that the invention is solely to be limited by the scope of the appended claims.

We claim:

1. A stylo pen tip with a drop weight body (7), located inside an inner bore (6) of a housing (1, 1') connected with a writing fluid reservoir (16), which has a cleaning wire (8) at its front end extending into a writing tube (2) supported on the front end of the housing (1, 1'), and a drop weight safety (13) supported therein which is pivotable around the longitudinal axis of the housing (1, 1') and which is in interlocking contact with the drop weight body (7), which can be moved back and forth axially in a limited way in relation to it, characterized in that the drop weight body (7) adjoins in its forward position with the front end (10) a stop face (9) formed in the inner bore (8), and in that the plane of the front end (10) of the drop weight body (7) and the plane of the stop face (9) are inclined towards each other.

2. A stylo pen tip in accordance with claim 1, characterized in that the plane of the front end (10) extends perpendicular to the longitudinal axis of the drop weight body (7).

3. A stylo pen tip in accordance with claim 1, characterized in that the front end (10) of the drop weight body (7) has a length which in general corresponds to the diameter of the drop weight body (7) and a width decreasing in a forward direction by the taper (11) of the drop weight body (7).

4. A stylo pen tip in accordance with claim 2, characterized in that the front end (10) of the drop weight body (7) has a length which in general corresponds to the diameter of the drop weight body (7) and a width decreasing in a forward direction by the taper (11) of the drop weight body (7).

5. A stylo pen tip in accordance with claim 1, characterized in that in the back end of the drop weight body (7) an indentation (12) is provided and in that a protrusion (15) is provided on the drop weight safety (13), the thickness of which is slightly less than the inner diameter of the indentation (12) and the width of which is greater than the inner diameter of the indentation (12), and extends into the indentation (12), the front end of the protrusion (15) being at a distance from the bottom of the indentation (12) when the drop weight body (7) is in its forward position.

6. A stylo pen tip in accordance with claim 2, characterized in that in the back end of the drop weight body (7) an indentation (12) is provided and in that a protrusion (15) is provided on the drop weight safety (13), the thickness of which is slightly less than the inner diameter of the indentation (12) and the width of which is greater than the inner diameter of the indentation (12), and extends into the indentation (12), the front end of the protrusion (15) being at a distance from the bottom of the indentation (12) when the drop weight body (7) is in its forward position.

7. A stylo pen tip with a drop weight body (7), located inside an inner bore (6) of a housing (1, 1') connected with a writing fluid reservoir (16), which has a cleaning wire (8) at its front end extending into a writing tube (2) supported on the front end of the housing (1, 1'), and a drop weight safety (13) supported therein which is pivotable around the longitudinal axis of the housing (1, 1') and which is in interlocking contact with the drop weight body (7), which can be moved back and forth axially in a limited way in relation to it, characterized in that a front end (10) of the drop weight body (7) adjoins in its forward position a stop face (9) formed in the inner bore (6) and inclined towards the longitudinal axis, and in that the plane of the front end (10) of the drop weight body (7) and the plane of the stop face (9) are inclined towards each other, and in that the front end (10) of the drop weight body (7) is of a length essentially equal to the diameter of the drop weight body (7) and a width which decreases in relation thereto towards the front by means of a taper (11) of the drop weight body (7).

8. A stylo pen tip in accordance with claim 7, characterized in that the plane of the front end (10) extends perpendicular to the longitudinal axis of the drop weight body (7).

9. A stylo pen tip in accordance with claim 7, characterized in that the back end of the drop weight body (7) an indentation (12) is provided and in that a protrusion (15) is provided on the drop weight safety (13), and extends into the indentation (12), the front end of the protrusion (15) being at a distance from the bottom of the indentation (12) when the drop weight body (7) is in its forward position.

10. A stylo pen tip in accordance with claim 8, characterized in that the back end of the drop weight body (7) an indentation (12) is provided and in that a protrusion (15) is provided on the drop weight safety (13), and extends into the indentation (12), the front end of the protrusion (15) being at a distance from the bottom of the indentation (12) when the drop weight body (7) is in its forward position.

* * * * *